US008215827B2

(12) United States Patent
Kato et al.

(10) Patent No.: US 8,215,827 B2
(45) Date of Patent: Jul. 10, 2012

(54) CHRONOGRAPH TIMEPIECE

(75) Inventors: Kazuo Kato, Chiba (JP); Akira Takakura, Chiba (JP); Kenji Ogasawara, Chiba (JP); Saburo Manaka, Chiba (JP); Kazumi Sakumoto, Chiba (JP); Hiroshi Shimizu, Chiba (JP); Tomohiro Ihashi, Chiba (JP); Keishi Honmura, Chiba (JP); Takanori Hasegawa, Chiba (JP); Kosuke Yamamoto, Chiba (JP); Eriko Noguchi, Chiba (JP)

(73) Assignee: Seiko Instruments Inc. (JP)

( * ) Notice: Subject to any disclaimer, the term of this patent is extended or adjusted under 35 U.S.C. 154(b) by 166 days.

(21) Appl. No.: 12/804,103

(22) Filed: Jul. 14, 2010

(65) Prior Publication Data

US 2011/0013493 A1 Jan. 20, 2011

(30) Foreign Application Priority Data

Jul. 16, 2009 (JP) ..... 2009-168254

(51) Int. Cl.
*G04F 7/00* (2006.01)
*G04F 8/00* (2006.01)

(52) U.S. Cl. ..... 368/106; 368/112

(58) Field of Classification Search ..... 368/101–106, 368/110, 112, 113
See application file for complete search history.

(56) References Cited

U.S. PATENT DOCUMENTS

| | | | | |
|---|---|---|---|---|
| 4,211,066 | A * | 7/1980 | Kusumoto et al. | 368/113 |
| 4,623,260 | A | 11/1986 | Kamiyama | 368/80 |
| 5,793,708 | A * | 8/1998 | Schmidt et al. | 368/106 |
| 6,370,087 | B1 * | 4/2002 | Akahane et al. | 368/110 |
| 7,029,169 | B2 * | 4/2006 | Takahashi et al. | 368/106 |
| 7,597,471 | B2 * | 10/2009 | Perret et al. | 368/101 |
| 2004/0218473 | A1 * | 11/2004 | Takahashi et al. | 368/37 |
| 2009/0161493 | A1 * | 6/2009 | Wyssbrod | 368/106 |

* cited by examiner

*Primary Examiner* — Vit Miska
(74) *Attorney, Agent, or Firm* — Adams & Wilks

(57) ABSTRACT

When it is judged that a chronograph second counter and a chronograph minute counter have measured a maximum measurement time, a maximum measurement control unit controls a drive pulse generation circuit so as to drive and stop a motor such that chronograph hand stops at predetermined positions. When, in this state, a restarting operation is performed on a start/stop button, a normal chronograph measurement operation is restarted. At this time, a mechanical structure has been restored to a reset state, so that even at the time of restarting after the measurement of the maximum measurement time, the load at the starting operation is the same as that of the normal operation, thus generating no sense of incongruity.

4 Claims, 5 Drawing Sheets

CHRONOGRAPH TIMEPIECE

BACKGROUND OF THE INVENTION

1. Field of the Invention

The present invention relates to a chronograph timepiece having a time indicating function and a time measuring function.

2. Background Art

Conventionally, there has been developed a chronograph timepiece in which a plurality of drive motors are mounted in order to respectively drive a plurality of indicator hands and which is endowed with a time information indicating function as its basic function and, further, with a chronograph time measurement function for performing time measurement, wherein the driving of the indicator hands is electrically effected by the drive motors, and the zero-restoring of chronograph hands is effected by a mechanical mechanism such as hearts (See, for example, JP-A-61-73085).

In normal use, in the above-mentioned chronograph timepiece, the click feel of an operating portion is heavy at the time of starting chronograph measurement and is light at the time of stopping chronograph measurement, thereby enabling the user to know which of the above two phases the current operation is based on the operational feel at the operating portion.

It should be noted, however, that in the case in which time measurement is performed up to a maximum measurement time, which is the maximum time that the chronograph timepiece is capable of performing, the chronograph measurement is electrically automatically stopped. Mechanically, however, a lever which is displaced in synchronization with the operation of the operating portion is maintained in the chronograph measurement state, so that when the operating portion is operated so as to resume chronograph measurement in this state, the resultant click feel is a light one as in the case of stopping operation, which means that the operational feel is not identical with that in normal use.

SUMMARY OF THE INVENTION

It is an aspect of the present invention to provide a chronograph timepiece in which the operational feel at the time of starting chronograph measurement and that at the time of stopping chronograph measurement differ from each other, wherein even when time measurement is performed up to the maximum chronograph measurement time, the operational feel at the time of starting chronograph measurement is not changed.

According to the present invention, there is provided a chronograph timepiece comprising: an operating means for performing a starting operation, a stopping operation, and a resetting operation of a chronograph measurement; a chronograph measurement means performing a chronograph measurement operation within a predetermined maximum measurement time; a chronograph hand for indicating chronograph-measured time; a driving means for driving the chronograph hand; a control means which controls the chronograph measurement means so as to start the chronograph measurement operation within the maximum measurement time in response to the starting operation, stop the chronograph measurement operation in response to the stopping operation, and perform resetting of the chronograph measurement operation in response to the resetting operation, and which controls the driving means so as to drive the chronograph hand in accordance with the time measured by the chronograph measurement means; and a lever means which is displaced from a zero-restored state to a starting state in response to the starting operation to release setting so as to enable the chronograph hand to be moved, which is displaced from the starting state to the zero-restored state in response to the resetting operation to set and retain the chronograph hand, and which makes the operational feel of the operating means different between the starting state and the zero-restored state, wherein when the chronograph measurement means has measured the maximum measurement time to attain a measurement stop state, the control means controls the chronograph measurement means and the driving means so as to start chronograph measurement operation to drive the chronograph hand when the starting operation is performed after the resetting operation.

In the chronograph timepiece of the present invention, even when time measurement is performed up to the maximum chronograph measurement time, it is possible to prevent the operational feel at the time of starting chronograph measurement from being changed.

DESCRIPTION OF THE PREFERRED EMBODIMENTS

Figure 3:
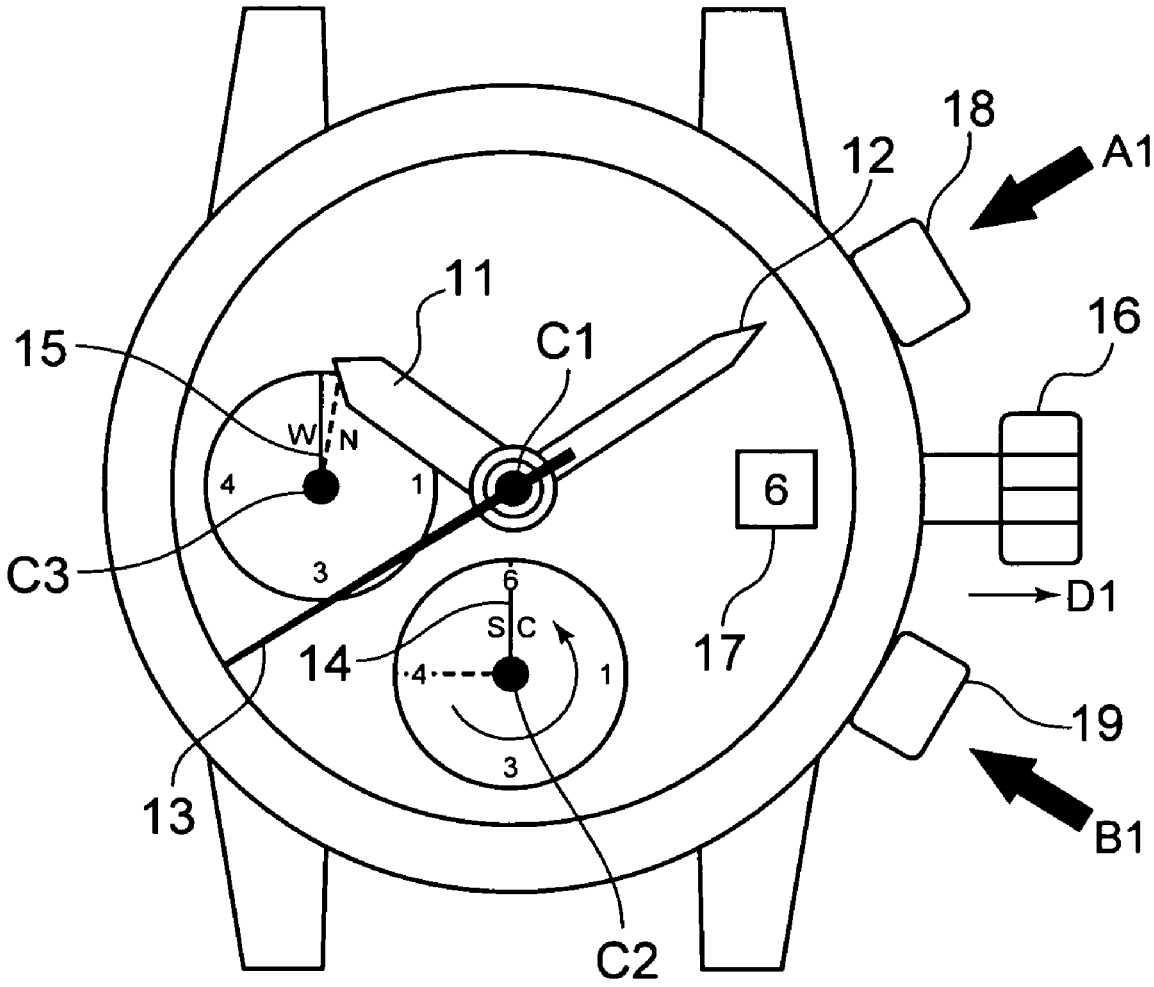
FIG. 3 is an external plan view of a chronograph timepiece according to an embodiment of the present invention.

As shown in FIG. 3, a chronograph timepiece 1 according to an embodiment of the present invention is in the form of a wristwatch, and is equipped with time hands (an hour hand 11, a minute hand 12, and a second hand 13) rotated around a center axis C1 and indicating the current time, and, at the same time, is equipped with chronograph hands (a chronograph secondhand 14 rotated around a center axis C2 and a chronograph minute hand 15 rotated around a center axis C3).

For example, by turning a winding stem 16 in a state in which it has been drawn out two steps in a direction D1, it is possible to rotate the time hands 11 through 13, and, by turning the winding stem 16 in a state in which it has been drawn out one step in the direction D1, it is possible to change a date 17 of a date indicator displayed through a window. The operation of the chronograph timepiece related to normal time display is the same as that of an ordinary electronic timepiece, and is well known to those skilled in the art, so that, in the following, a description of the structure, function, and operation related to normal hand movement will be omitted.

In the chronograph timepiece 1, the chronograph hands 14, 15 are electrically drive-controlled by a stepping motor, and zero-restoring-controlled by a mechanical construction.

In the chronograph timepiece 1, by depressing a start/stop button 18 in a direction A1, there is given an instruction to start or stop a chronograph operation by the chronograph timepiece 1. More specifically, the starting/stopping of the chronograph operation implies the starting/stopping of the chronograph hands 14, 15; as described below, in this connection, there are effected the operation of the electrical drive system and the retention of electrical positional information on the chronograph hands. In some cases, however, there is no need to retain electrical positional information on the chronograph hands. The start/stop button 18 and the reset button 19 constitute an operating means.

In the chronograph timepiece 1, by depressing the reset button 19 in a direction B1, there is given an instruction for the chronograph operation by the chronograph timepiece 1 to be reset, i.e., to be restored (zero-restored) to the initial state. More specifically, the resetting of the chronograph operation implies forcible restoring (zero-restoring) of the chronograph hands 14, 15 to the initial positions (time indicating positions), and the setting of the movement of the chronograph hands 14, 15 as well as the resetting of the electrical positional information on the chronograph hands.

First, a mechanical structure 5 and the operation thereof related to the starting, hand movement, and zero-restoring of the chronograph timepiece 1 will be described mainly with reference to FIGS. 2A and 2B. The mechanical structure 5 related to the starting, hand movement, and zero-restoring of the chronograph timepiece 1 is also briefly shown in the left-hand side portion of the block diagram of FIG. 1.

Apart from a normal hand movement (time indication hand movement) motor (not shown), the chronograph timepiece 1 is equipped with a chronograph hand movement motor 35; when rotated, the chronograph hand movement motor 35 moves the chronograph hands 14, 15 via a chronograph hand movement train wheel 36.

The normal hand movement motor and the chronograph hand movement motor 35 are stepping motors of a well-known construction used for timepieces. Each of the stepping motor includes a stator having a rotor accommodating hole and a positioning portion determining a stop portion of a rotor, a rotor arranged in the rotor accommodating hole, and a drive coil, and adapted to supply the drive coil with alternating signals (drive pulses) whose polarity alternately changes to generate a magnetic flux in the stator to thereby rotate the rotor, and to stop the rotor at a position corresponding to the positioning portion. The rotor is continuously rotated by a predetermined angle (e.g., 180 degrees) each time it is alternately driven by the drive pulses of different polarities, and, even if it is continuously driven by a plurality of drive pulses of the same phase, when it is rotated by the first drive pulse, it is not rotated by the pulses of the same phase from the second drive pulse onward.

The chronograph timepiece 1 is equipped with a chronograph second cam 22 mounted to a chronograph second arbor 21 with the chronograph second hand 14, and a chronograph minute cam 24 mounted to a chronograph minute arbor 23 with the chronograph minute hand 15.

Further, the chronograph timepiece 1 is equipped with a hammer operating first lever (hereinafter also referred to as "the hammer operating lever B") 25, a hammer operating second lever (hereinafter also referred to as "the hammer operating lever A") 26, a hammer 27, and a stop lever 28.

The chronograph second cam 22, the chronograph minute cam 24, and the hammer 27 constitute a setting mechanism, and the hammer operating second lever 26 and the hammer 27 constitute a releasing means. Further, the chronograph second cam 22, the chronograph minute cam 24, the hammer 27, the hammer operating first lever 25, and the hammer operating second lever 26 constitute a mechanical resetting means. Further, the hammer operating first lever 25, the hammer operating second lever 26, and the hammer 27 also constitute a lever means.

The hammer operating first lever 25 is rotatable between a reference position J1 (indicated by the solid line in FIG. 2B) and a zero-restoring position J2 (indicated by the solid line in FIG. 2A and by the dotted line in FIG. 2B); a positioning pin 25*a* is engaged with a spring-like positioning member 29 equipped with an engagement groove, whereby positioning is effected thereon at the reference position J1 or the zero-restoring operation position J2. An elongated hole 26*a* of the hammer operating second lever 26 is engaged with a pin 25*b* of the hammer operating first lever 25. When the hammer operating first lever 25 is moved from the reference position J1 to the zero-restoring position J2 and position setting is effected, the hammer operating second lever 26 is moved from the reference position K1 (indicated by the solid line in FIG. 2B) to the zero-restoring position K2 (indicated by the solid line in FIG. 2A and by the dotted line in FIG. 2B).

On the other hand, when the hammer operating second lever 26 is moved from the zero-restoring position K2 to the reference position K1 and position setting is effected, the hammer operating first lever 25 is moved from the zero-restoring position J2 to the reference position J1 and positioning is effected thereon.

An elongated hole 27*a* of the hammer 27 is engaged with a pin 26*b* of the hammer operating second lever 26, and positioning is effected thereon at a reference position M1 (indicated by the solid line in FIG. 2B) or at a zero-restoring position M2 (indicated by the solid line in FIG. 2A and by the dotted line in FIG. 2B) in accordance with the position setting of the hammer operating second lever 26 to the reference position K1 or the zero-restoring position K2.

When the hammer 27 is set at the zero-restoring position M2, a second hammer portion 27*b* of the hammer 27 strikes the chronograph second cam 22 to zero-restore the chronograph second hand 14 to the initial position, and a minute hammer portion 27*c* thereof strikes the chronograph minute cam 24 to zero-restore the chronograph minute hand 15 to the initial position.

Figure 2A:
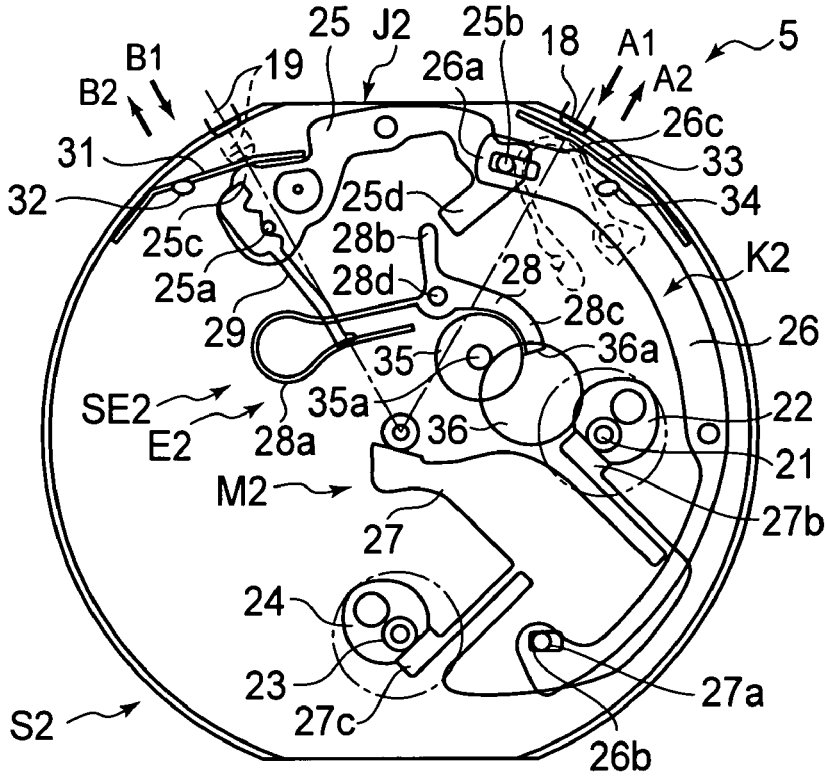
FIGS. 2A and 2B are plan views schematically illustrating the mechanical construction of a chronograph mechanism of a chronograph timepiece according to an embodiment of the present invention.
Figure 2B:
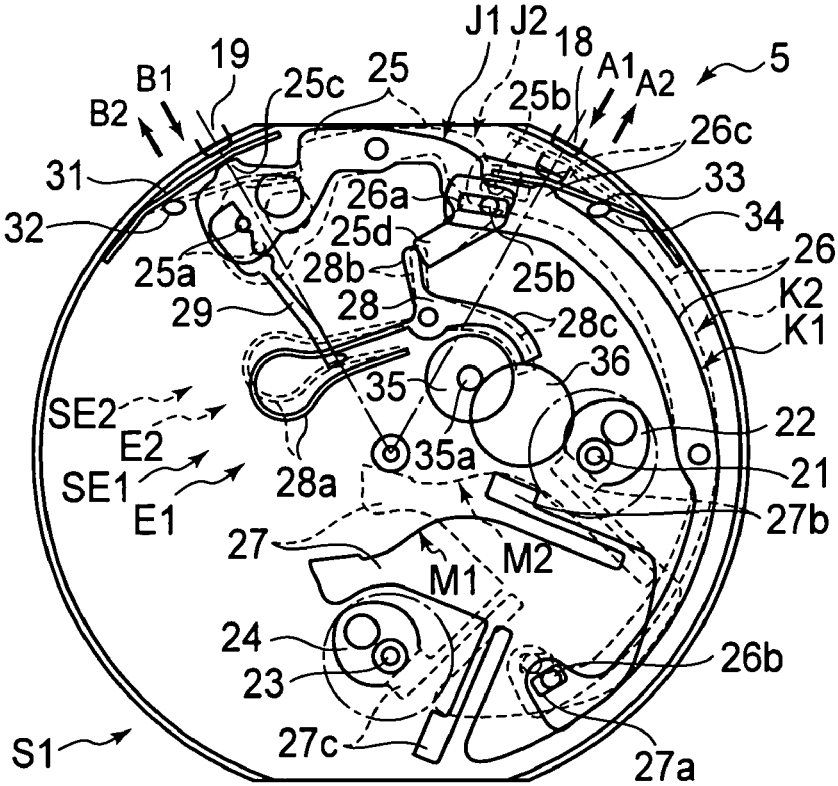

The stop lever 28 is equipped with a spring portion 28*a*, an engagement arm portion 28*b*, and a lock arm portion 28*c*, and is rotatable around a pin 28*d* between a correction control position at the time of zero-restoring or setting position E2 (indicated by the solid line in FIG. 2A and by the dotted line in FIG. 2B) and a correction control cancelling position or setting releasing position E1 (indicated by the solid line in FIG. 2B). In a state SE2 in which the stop lever 28 is at the setting position E2, the lock arm portion 28*c* of the stop lever 28 is engaged with one wheel 36*a* of the chronograph hand movement train wheel 36 connected to a rotor cogwheel 35*a* of the chronograph hand movement motor 35 to set the rotation of the train wheel 36, and, in a state SE1 in which the stop lever 28 is at the setting releasing position E1, it is separated from the wheel 36*a* of the train wheel 36, and permits the rotation of the rotor cogwheel 35*a* of the motor 35 and of the train wheel 36.

When the hammer operating first lever 25 is rotated from the zero-restoring position J2 to the reference position J1, the engagement arm portion 28*b* of the stop lever 28, the spring portion 28*a* of which is under a biasing force toward the setting position E2, is engaged with the arm portion 25*d* of the hammer operating first lever 25, and the stop lever is rotated and displaced from the setting position E2 at the time of zero-restoring to the setting releasing position E1. On the other hand, when the hammer operating first lever 25 is moved from the reference position J1 to the zero-restoring position J2, the engagement of the arm portion 25*d* of the hammer operating first lever 25 and the engagement arm portion 28*b* is released, so that the stop lever 28 is restored from the setting releasing position E1 to the setting position E2 by the resilient force of the spring portion 28*a* of the stop lever 28.

When the start/stop button 18 is depressed in the direction A1, with the chronograph timepiece 1 being in the zero-restoring (resetting) state S2 shown in FIG. 2A, a protrusion 26*c* of the hammer operating second lever 26 is depressed in the direction A1, and the lever is displaced from the position K2 to the position K1 and, at the same time, the hammer operating first lever 25 is displaced from the position J2 to the position J1, with the hammer 27 being displaced from the position M2 to the position M1. As a result, the rotation setting (zero-restoring control) of the hearts 22, 24 and the chronograph hands 14, 15 by the hammer portions 27*b*, 27*c* is released. Further, in response to the rotation of the hammer operating first lever 25 from the position J2 to the position J1, the stop lever 28 whose arm portion 28*b* is engaged with the arm portion 25*d* of the hammer operating first lever 25 is rotated from the setting position E2 to the setting releasing position E1, and the lock arm portion 28*c* of the stop lever 28 is detached from the chronograph train wheel 36 to release the rotation setting (stop control) of the train wheel 36. As a result, the mechanical control mechanism 5 is restored to the state S1, and the chronograph hands 14, 15 become rotatable.

On the other hand, when the reset button 19 is depressed in the direction B1, with the chronograph timepiece 1 being in the start state or hand movement state S1 shown in FIG. 2B, the protrusion 25*c* of the hammer operating first lever 25 is pressed in the direction B1, and the hammer operating first lever 25 is displaced from the position J1 to the position J2. When the hammer operating first lever 25 is displaced from the position J1 to the position J2, the hammer operating second lever 26 engaged with the lever 25 is moved from the position K1 to the position K2 on the one hand, and the hammer 27 engaged with the lever 26 is moved from the position M1 to the position M2, with the second hammer 27*b* and the minute hammer 27*c* striking the second heart 22 and the minute heart 24 to zero-restore the chronograph second hand 14 and the chronograph minute hand 15; on the other hand, the lock of the arm portion 25*d* with respect to the stop lever 28 is released, and the stop lever 28 is rotated from the position E1 to the position E2, with the arm portion 28*c* being engaged with the chronograph train wheel 36 to effect setting on the train wheel 36.

As described above, when the start/stop button 18 is depressed in the direction A1 to perform start operation, with the chronograph timepiece being in the zero-restoring (resetting) state S2 shown in FIG. 2A, the switch spring 33, the hammer operating lever 26, the hammer operating lever 25, and the hammer 27 constitute the load (first load) at the time of start operation.

On the other hand, as described in detail below, when a maximum measurement time, which is the maximum time the chronograph timepiece is capable of measuring, has been measured, the electrical measurement means terminates the time measuring operation, and the chronograph hands stop at predetermined positions; since the levers 25 through 27 of the mechanical structure 5 have not been reset, the chronograph timepiece is kept in the start state or hand movement state S1 shown in FIG. 2B. Thus, when the chronograph measurement is restarted in this state, the start/stop button 18 is depressed in the direction A1 in the state as shown in FIG. 2B.

The load (second load) when the mechanical structure 5 of the chronograph timepiece 1 is in the start state or hand movement state S1 as shown in FIG. 2B is the switch spring 33 only, and it is greatly different from the load at the time of normal start operation, so that the user feels a sense of incongruity. As described below, in this embodiment, when the maximum measurement time is measured, chronograph measurement operation can only be restarted after the zero-restored state S2 of FIG. 2A is restored through resetting operation, whereby the load at the time of restart operation after the measurement of the maximum measurement time is made equal to the normal start operation load.

When the chronograph timepiece 1 is in the start state or hand movement state S1 shown in FIG. 2B, the load (third load) at the time of reset operation of the reset button 19 is the switch spring 31, the hammer operating lever 25, the hammer operating lever 26, and the hammer 27.

Regarding the chronograph timepiece 1, the electrical aspect thereof with regard to the mechanical structure 5 shown in FIGS. 2A and 2B are as follows.

When, with the chronograph timepiece 1 being in the reset state S2 shown in FIG. 2A, the start/stop button 18 is depressed in the direction A1, the start/stop button 18 presses the start/stop switch button 33 exerting a biasing force in the direction A2 in the vicinity of the depth end thereof to close a contact portion 34, generating a start signal Pa (FIG. 1) via the contact portion 34. When the start/stop button 18 is depressed in the direction A1, with the chronograph timepiece 1 being in the start state S1 shown in FIG. 2B, the start/stop button 18 presses the start/stop switch spring 33 to close the contact portion 34, generating a stop signal Pb (FIG. 1) via the contact portion 34.

On the other hand, when the reset button 19 is depressed in the direction B1, with the chronograph timepiece 1 being in the start state (or stop state) shown in FIG. 2B, the reset button 19 presses the reset switch spring 31 exerting a biasing force in the direction B2 in the vicinity of the depth end thereof to close a contact portion 32, generating a reset signal Qa (FIG. 1) via the contact portion 32.

Of the above operations, in the following, there will be described in more detail mainly the start and progress of the start operation when the start/stop button 18 is depressed in the direction A1 in the zero-restored state S2 of FIG. 2A.

That is, as the start/stop button 18 is depressed in the direction A1, there is issued, on the one hand, an electrical drive start signal Pa via a switch contact 34, whereby the motor 35 is rotated; on the other hand, through the rotation of the hammer 27 as a result of the rotation of the hammer operating second lever 26, the mechanical zero-restored state is released, and, at the same time, through the rotation of the stop lever 28 as a result of the rotation of the hammer operating second lever 26 and the hammer operating first lever 25, the lock of the train wheel 36 (stop control state) is released to mechanically permit hand movement (i.e., the mechanical setting is released).

Here, for the chronograph timepiece 1 to operate properly to accurately perform time measurement, it is necessary for the rotation of the motor 35 to be effected after the completion of the mechanical setting releasing. In the chronograph timepiece 1, the electrical drive is reliably effected after the completion of the mechanical setting releasing while avoiding complication of the structure and an increase in cost entailed. Further, in the case in which the maximum measurement time is measured, restarting operation is possible only when the zero-restored state S2 of FIG. 2A is restored through resetting operation, whereby the restart operation load after the measurement of the maximum measurement time is made equal to the normal start operation load. In the following, mainly this point will be described in detail.

Next, the outline of an electrical drive mechanism 6 of the chronograph timepiece 1 will be described mainly with reference to the block diagram of FIG. 1 while also referring to the mechanical structure 5 of FIGS. 2A and 2B.

The rotation of the chronograph hand movement motor 35 of the chronograph timepiece 1 is controlled by a drive control integrated circuit 50 for the chronograph hand movement motor 35 drive-controlled based on clock pulses imparted via an oscillator circuit 41 and a frequency divider circuit 42.

The motor drive control integrated circuit 50 has a basic drive control unit 51, a drive pulse generation circuit 52, a motor drive circuit 53, a zero-restoring control unit 54, a rotation detection circuit 55, and a maximum measurement control unit 61 making a judgment as to whether there has been effected the measurement of the maximum measurement time, which is the maximum time the chronograph timepiece 1 is capable of measuring. Here, a drive means of the chronograph hand movement motor 35 has the drive pulse generation circuit 52, the motor drive circuit 53, and the rotation detection circuit 55. Further, a control means has the basic drive control unit 51, the zero-restoring control unit 54, and the maximum measurement control unit 61. The zero-restoring control unit 54 constitutes an electrical resetting means for electrical resetting, and constitutes, together with the above-mentioned mechanical resetting means, a resetting means.

Further, the motor drive control integrated circuit 50 has a chronograph second counter 57 counting chronograph seconds and retaining the chronograph second information, and a chronograph minute counter 58 counting chronograph minutes and retaining the chronograph minute information. Further, there is provided a chronograph hour counter counting chronograph hours and retaining the chronograph hour information.

The basic drive control unit 51 receives a start signal or operation signal Pa imparted via the contact portion 34 in response to the depression of the start/stop button 18 when the chronograph timepiece 1 is in the zero-restored state S2.

Upon receiving the start signal or operation signal Pa, the basic drive control unit 51 emits a drive control signal Pd after a short interval for preventing chattering. In the following, unless otherwise specified, the point in time when the start signal or operation signal Pa is received and the point in time when the drive control signal Pd is transmitted are substantially identical with each other. The drive control signal Pd is a signal maintained at high level while the chronograph operation is being conducted.

Further, the basic drive control unit 51 stops the transmission of the drive control signal Pd upon receiving a stop signal Pb imparted via the contact portion 34 in response to the depression of the start/stop button 18 (or in response to the stopping of the emission of the start signal or operation signal Pa from the contact portion 34) when the chronograph timepiece 1 is in the start state S1.

The drive control signal Pd from the basic drive control unit 51 is also imparted to the chronograph second counter 57; while the drive control signal Pd is maintained at high level, the chronograph second counter 57 receives clock pulses imparted from the frequency divider circuit 42 to count chronograph seconds and, at the same time, using the point in time when the chronograph time measurement is started based on the drive control signal Pd as the start point, emits a chronograph timing pulse Ph for each cycle T. The cycle T of the pulse Ph (the chronograph hand drive cycle) corresponds to the time measurement accuracy of the chronograph timepiece 1; it is, for example, 1/100 sec (that is, 10 ms). One hand movement (one step) of a chronograph hand corresponds to the time measurement accuracy.

Upon receiving the drive control signal Pd, the drive pulse generation circuit 52 imparts main drive pulses G for normal chronograph hand drive to the motor drive circuit 53. The motor drive circuit 53 imparts motor drive pulses U corresponding to the main drive pulses G to the chronograph hand movement motor 35 to rotate the motor 35. Thereafter, the motor 35 is alternately driven by the normal main drive pulses U of different polarities (P1-1, P1-2) to be rotated by a predetermined angle at one time.

On the other hand, when the basic drive control unit 51 receives the stop signal Pb, the basic drive control unit 51 stops the emission of the drive control signal Pd (If so desired, it may provide a drive stop signal Pf), the emission of the drive pulses G from the drive pulse generation circuit 52 is stopped, the emission of the motor drive pulse U from the motor drive circuit 53 is stopped, the rotation of the chronograph hand movement motor 35 is stopped, and the rotation of the rotor or output shaft of the motor 35 is stopped, thus stopping the movement of the chronograph hands 14, 15 via the chronograph hand movement train wheel 36.

When the switch spring 31 is depressed through the depression of the reset button 19 to close the contact portion 32, the reset signal Qa is imparted to the zero-restoring control unit 54. Upon receiving the reset signal Qa from the contact portion 32, the zero-restoring control unit 54 imparts the drive stop signal Pf to the drive pulse generation circuit 52. As a result, the drive pulse generation circuit 52 stops the generation of the drive pulses G, stopping the emission of the motor drive pulses U by the motor drive circuit 53. Thus, the rotation of the chronograph hand movement motor 35 is stopped, and the movement of the chronograph hands 14, 15 is stopped.

In response to the reception of the reset signal Qa, the zero-restoring control unit 54 resets the contents of the chronograph second counter 57 and of the chronograph minute counter 58 to zero. The zero-restoring control unit 54 perform chronograph reset control (hand movement stop and counter resetting) on the basis of the reset signal Qa based on the resetting operation of the reset button 19.

When the motor 35 is already being driven at the time of the operation of the reset button, the basic drive control unit 51 refers to the result obtained by the rotation detection circuit 55 and, when the rotation detection circuit 55 detects non-rotation, judges to be non-rotation due to the mechanical setting, and the polarity of the drive pulse for the next driving by the motor drive circuit 53 is not reversed. As a result, when non-rotation due to the setting at the time of zero-restoring is detected, the drive is started by a drive pulse U of the same phase as the previous one at the time of restart of the chronograph measurement operation.

On the other hand, when the start signal Pa is input, the maximum measurement control unit 61 starts the operation of judging as to whether the measurement of the maximum measurement time has been conducted or not. When the stop signal Pb is input, the maximum measurement control unit 61 stops the operation of judging as to whether the measurement of the maximum measurement time has been conducted or not.

The maximum measurement control unit 61 judges that the measurement of the maximum measurement time has been conducted by receiving a carry signal output from the chronograph minute counter 58 when the chronograph second counter 57 and the chronograph minute counter 58 measure the maximum measurement time.

When it is judged that the chronograph second counter 57 and the chronograph minute counter 58 have measured the maximum measurement time, the maximum measurement control unit 61 controls the drive pulse generation circuit 52 so as to drive and stop the motor 35 such that the chronograph hands 14, 15 are stopped at predetermined positions.

When it is judged that the chronograph second counter 57 and the chronograph minute counter 58 have measured the maximum measurement time, the maximum measurement control unit 61 prohibits the drive pulse generation circuit 52 to drive the motor 35 until the reset signal Qa is input.

When the reset signal Qa is input, the maximum measurement control unit 61 releases the prohibition control of the drive operation with respect to the drive pulse generation circuit 52 to enable the drive pulse generation circuit 52 to rotate the motor 35.

Figure 1:
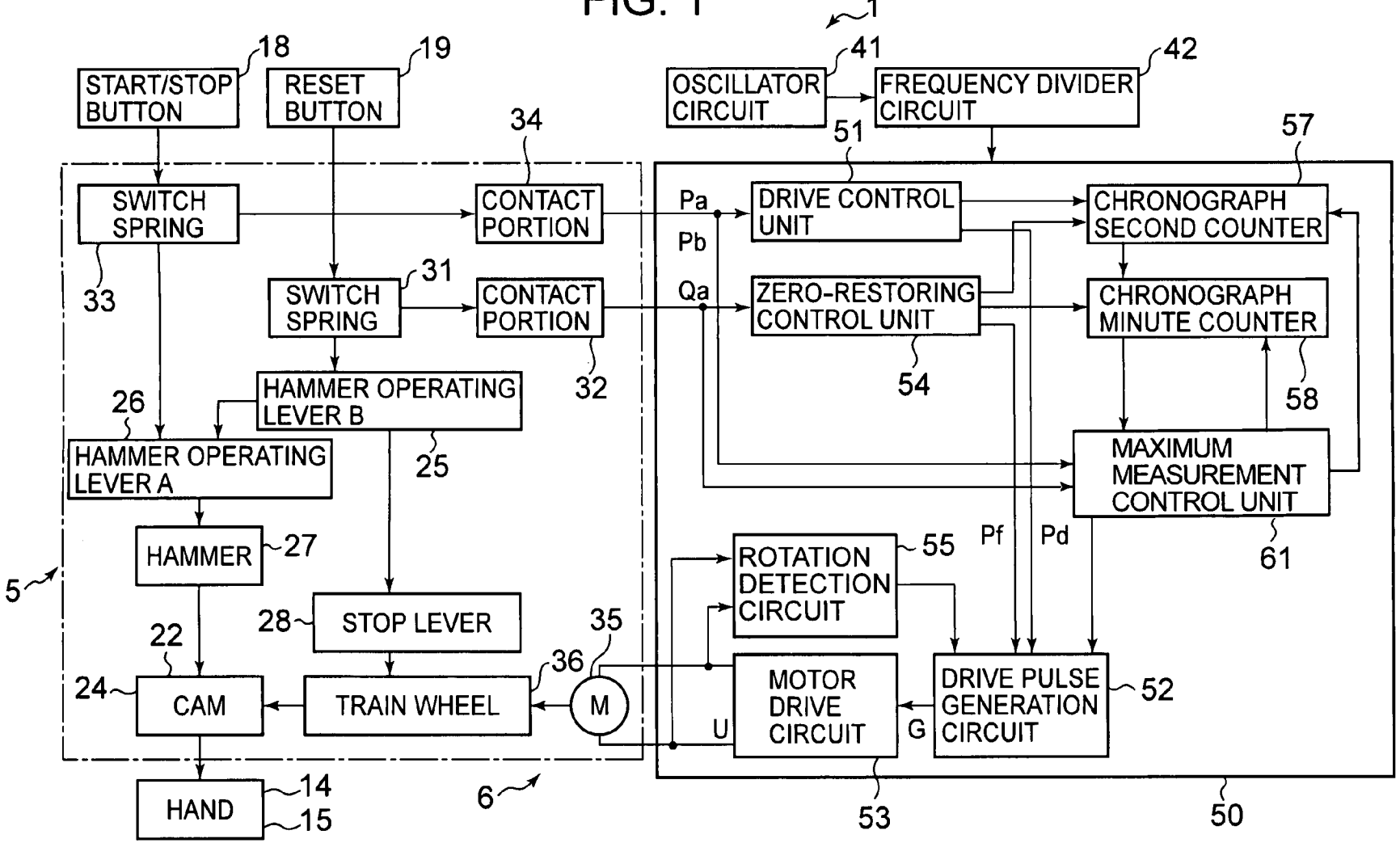
FIG. 1 is a block diagram showing a chronograph timepiece according to an embodiment of the present invention.
Figure 4:
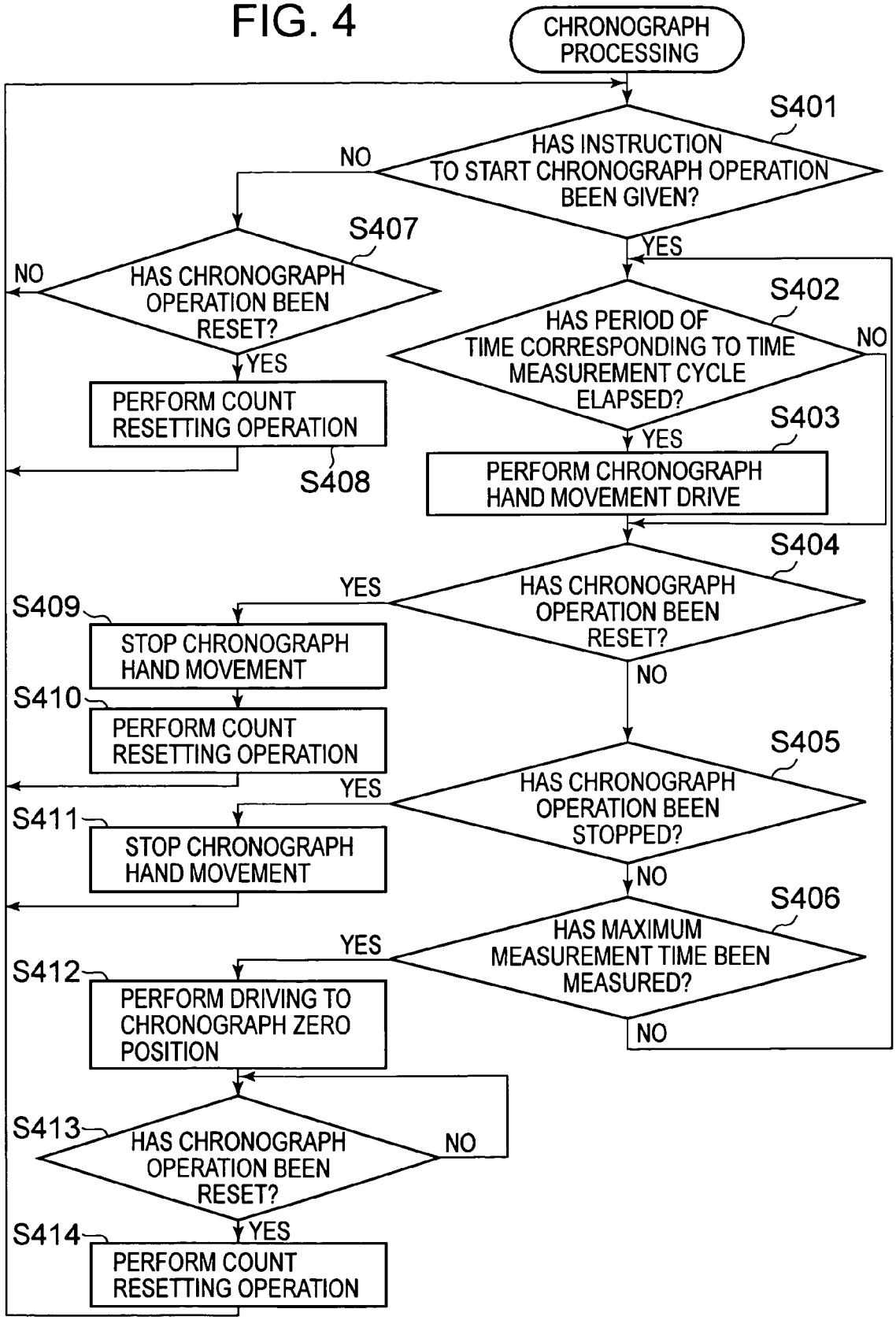
FIG. 4 is a flowchart illustrating an embodiment of the present invention.

Next, the operation of the chronograph timepiece 1 constructed as described above will be illustrated mainly with reference to the flowchart of FIG. 4 while also referring to FIGS. 1 through 3. This flowchart shows mainly the operation of the basic drive control unit 51 and the maximum measurement control unit 61 of the integrated circuit 50 of the chronograph timepiece 1 of FIG. 1 as a program processing flow corresponding to the operation.

In the chronograph timepiece 1, in the first processing step S401, the basic drive control unit 51 checks whether an instruction to start the chronograph operation has been given or not. This start check step S401 corresponds to the checking as to whether or not the contact portion 34 has been closed for contact through the displacement in the direction A1 of the switch spring 33 through the depression in the direction A1 of the start/stop button 18, causing an operation signal or start signal Pa to be imparted from the contact portion 34 to the basic drive control unit 51 of the integrated circuit 50.

In the case in which no start signal Pa has been output, the zero-restoring control unit 54 checks in step S407 as to whether a reset (zero-restoring) instruction has been issued or not. This reset check step S407 corresponds to the checking as to whether or not the contact portion 32 has been closed through the displacement in the direction B1 of the switch spring 31 through the depression in the direction B1 of the reset (zero-restoring) button 19, causing the reset signal Qa to be imparted from the contact portion 32 to the zero-restoring control unit 54 of the integrated circuit 50. In the case in which no reset signal Qa has been output, the procedure returns to the first processing step S401. In the case in which the reset signal Qa has been output, the zero-restoring control unit 54 performs in step S408 a count resetting processing to restore the contents of the chronograph second counter 57 and of the chronograph minute counter 58 to zero, and the procedure returns to the first processing step S401.

When the chronograph operation start instruction (start signal Pa) is confirmed in the start check step S401, the basic drive control unit 51 checks in step S402 whether a period of time corresponding to the time measurement cycle T of the chronograph operation (which, in this case, is, for example, 1/100 sec, that is, 10 ms) has elapsed or not. When the time measurement cycle T has been attained, the procedure advances to step S403. This corresponds to the operation in which the timing pulse Ph is output when the period of time from the point in time when the chronograph time measurement operation is started has been measured and a time corresponding to the time measurement cycle T has been attained.

When the basic drive control unit 51 judges that the period of time T has elapsed (step S402), the drive pulse generation circuit 52 imparts the drive pulse G to the motor drive circuit 53 so as to move the chronograph hands 14, 15, and imparts the motor drive pulse U corresponding to the drive pulse G to the chronograph hand movement motor 35 to rotate the motor 35 (step S403). When the basic drive control unit 51 judges in step S402 that the period of time T has not elapsed, the procedure immediately advances to step S404.

Next, the zero-restoring control unit 54 judges whether resetting operation has been performed on the reset button 19 or not (step S404). When it is judged in step S404 that resetting operation has been performed on the reset button 19, the zero-restoring control unit 54 transmits a drive stop signal Pf to the drive pulse generation circuit 52 to stop the rotation of the motor 35 to thereby stop the hand movement (step S409), resetting the count values of the chronograph second counter 57 and of the chronograph minute counter 58 to zero (step S410), and then the procedure returns to step S401.

In the case in which the zero-restoring control unit 54 judges in step S404 that the resetting operation has not been performed on the reset button 19, when a stopping operation has been judged to have been performed on the start/stop button 18 by receiving the stop signal Pb via the contact portion 34 (step S405), the basic drive control unit 51 stops the counting operation on the chronograph second counter 57 and the chronograph minute counter 58, and stops the transmission of the drive control signal Pd to the drive pulse generation circuit 52 to stop the chronograph hand movement (step S411) before the procedure returns to step S401.

In the case in which the basic drive control unit 51 judges in step S405 that no stopping operation has been performed, when it is judged that the maximum measurement time has been measured by receiving the carry signal from the chronograph minute counter 58 (step S406), the maximum measurement control unit 61 controls the drive pulse generation circuit 52 so as to drive and stop the motor 35 such that the chronograph hands 14, 15 are stopped at predetermined positions (step S412). At the same time, the maximum measurement control unit 61 stops the time measurement of the chronograph second counter 57 and the chronograph minute counter 58, and prohibits the input from the start/stop button 18. In the example of FIG. 4, the predetermined positions where the chronograph hands 14, 15 are stopped are chronograph zero positions (zero-restored positions). The drive pulse generation circuit 52 rotates the motor 35 via the motor drive circuit 53 such that the chronograph hands 14, 15 stop at the predetermined positions, and then stops the driving.

Next, when it is judged that resetting operation has been performed on the reset button 19 (step S413), the maximum measurement control unit 61 effects control so as to reset and operate the chronograph second counter 57 and the chronograph minute counter 58, and the input prohibition of the start/stop button is released (step S414) before the procedure returns to step S401.

In this way, in the case in which the chronograph measurement time has attained the maximum measurement time, no starting operation is accepted until the resetting operation is performed through the reset button 19.

The chronograph hands 14, 15 are in the zero-restored state, and the mechanical drive mechanism 5 and the electrical drive mechanism 6 have been restored to the reset state, so that when restarting is effected thereafter in step S401, the normal chronograph measurement operation is restarted. At this time, the mechanical structure 5 has been restored to the reset state, so that even at the time of restarting after the measurement of the maximum measurement time, the load at the time of starting operation by the start/stop button 18 is the same as that of the normal operation, thus generating no sense of incongruity at the time of starting operation.

When the maximum measurement control unit 61 judges in step S406 that the maximum measurement time has not been measured, the procedure returns to step S402 to conduct the above processing.

Figure 5:
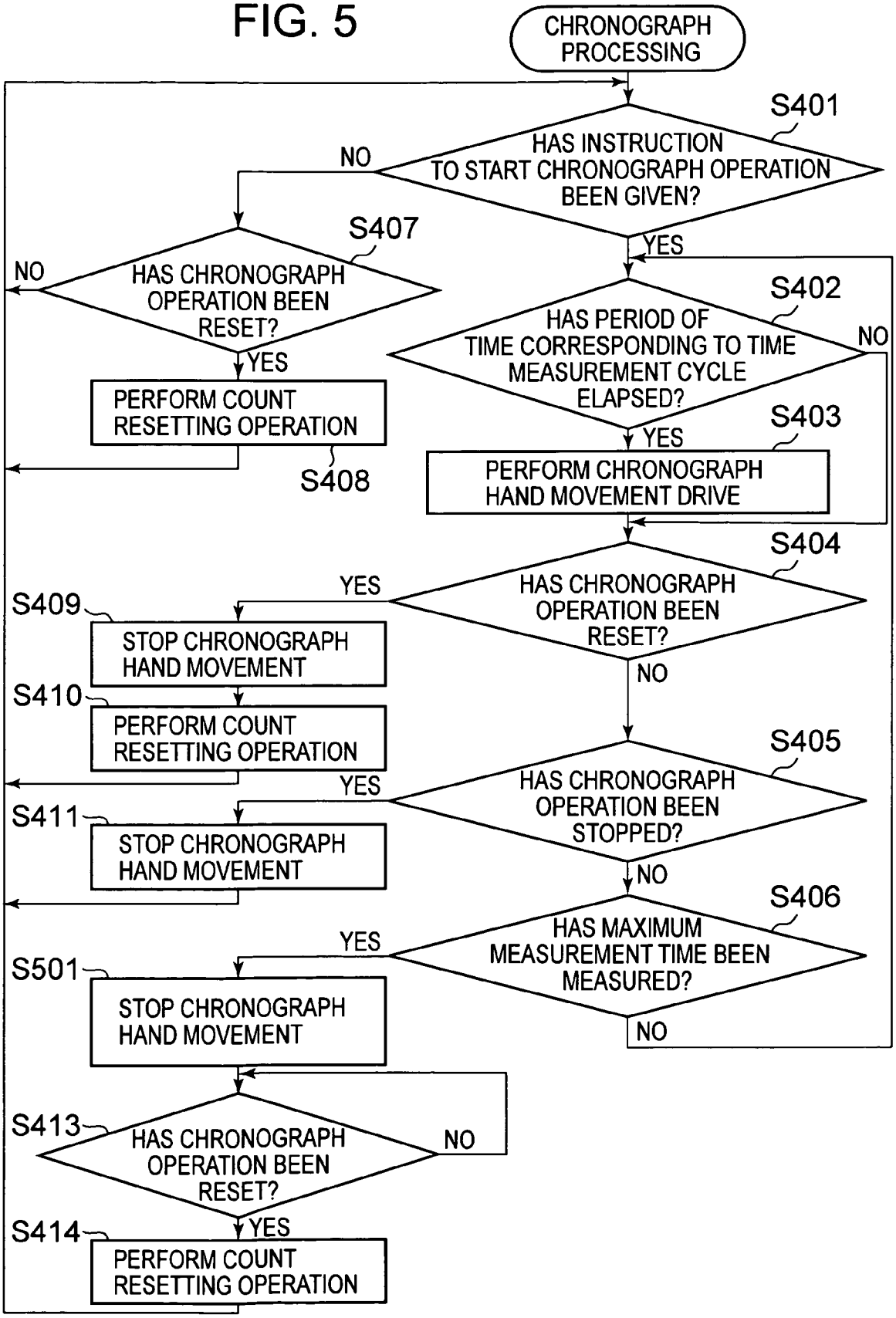
FIG. 5 is a flowchart illustrating another embodiment of the present invention.

FIG. 5 is a flowchart for a chronograph timepiece according to another embodiment of the present invention; the same processing portions as those of FIG. 4 are indicated by the same reference numerals. The electrical construction and the mechanical construction of the other embodiment are the same as those of FIGS. 1 through 3. In the following, only the points differing from the above embodiment will be illustrated.

When it is judged in step S406 that the maximum measurement time has been measured by receiving the carry signal from the chronograph minute counter 58, the maximum measurement control unit 61 controls the drive pulse generation circuit 52 such that the chronograph hands 14, 15 are stopped at predetermined positions (step S501). In the example of FIG. 5, the predetermined positions may be positions before the zero-restoring positions by a predetermined amount, for example, positions one step before the maximum measurement time. When the chronograph hands 14, 15 have been moved to positions one step before the maximum measurement time, the drive pulse generation circuit 52 stops the rotation of the motor 35 so as to cause the hands to stop at the positions. In this way, the chronograph hands 14, 15 are stopped at positions other than the zero-restoring positions, whereby it is possible for the user to easily recognize that the maximum time measurement has been performed and that resetting has been effected. The user performs resetting operation to restore the chronograph hands 14, 15 to the zero-restoring positions to zero-restore the chronograph hands 14, 15. When restarting is effected in this state, the normal chronograph measurement operation is restarted. At this time, the mechanical structure 5 has been restored to the reset state, so that even at the time of restarting after the measurement of the maximum measurement time, the load at the time of starting operation is the same as that at the time of the normal operation, thus generating no sense of incongruity at the time of starting operation.

As described above, the chronograph timepiece of the embodiment of the present invention comprises: operating means 18, 19 for performing a starting operation, a stopping operation, and a resetting operation of a chronograph measurement; chronograph measurement means 57, 58 performing a chronograph measurement operation within a predetermined maximum measurement time; chronograph hands 14, 15 for indicating chronograph-measured time; driving means 52, 53, 55 for driving the chronograph hands 14, 15; control means 51, 54, 61 which control the chronograph measurement means 57, 58 so as to start the chronograph measurement operation within the maximum measurement time in response to the starting operation, stop the chronograph measurement operation in response to the stopping operation, and perform resetting of the chronograph measurement operation in response to the resetting operation, and which control the driving means 52, 53, 55 so as to drive the chronograph hands 14, 15 in accordance with the time measured by the chronograph measurement means 57, 58; and lever means 25 through 27 which are displaced from a zero-restored state to a starting state in response to the starting operation to release setting so as to enable the chronograph hands 14, 15 to be moved, which are displaced from the starting state to the zero-restored state in response to the resetting operation to set and retain the chronograph hands 14, 15, and which make the operational feel of the operating means 18, 19 different between the starting state and the zero-restored state, wherein when the chronograph measurement means 57, 58 have measured the maximum measurement time to attain a measurement stop state, the control means 51, 54, 56 control the chronograph measurement means 57, 58 and the driving means 52, 53, 55 so as to start chronograph measurement operation to drive the chronograph hands 14, 15 when the starting operation is performed after the resetting operation.

That is, in the chronograph timepiece 1 in which the operation load of the start/stop button 18 at the time of starting chronograph measurement and that at the time of stopping chronograph measurement differ from each other, in the case in which the maximum measurement time is measured and the chronograph measurement operation is completed with the chronograph hands 14, 15 stopping at predetermined positions, the maximum measurement control unit 61 restarts the chronograph measurement operation when the starting operation is performed on the start/stop button 18 after the operation by the reset button 19.

While conventionally the chronograph time measurement is automatically stopped when the maximum measurement time is attained, and the chronograph measurement operation is restarted at the time of the next starting operation, the input by the start switch is electrically prohibited until the resetting operation, whereby starting operation is always effected on the setting levers in the same state, making it possible to prevent generation of a disparity between the switch operational feel at the time of starting operation and that at the time of stopping operation. In this way, even when the time measurement is conducted up to the maximum chronograph measurement time, it is possible to prevent a change in the operational feel at the time of chronograph measurement start.

While in the chronograph of the above-described embodiment, the chronograph second hand is arranged on the 6 o'clock side, and the chronograph minute hand is arranged on the 9 o'clock side, the present invention is also applicable to a center chronograph using the hand 13 as the chronograph second hand.

Further, the present invention is also applicable to a retro-chronograph timepiece.

Further, in order to increase the operation load of the start/stop button 18, it is also possible to additionally provide a spring different from the switch spring 33.

The present invention is applicable to various types of chronograph timepieces in which the driving of the time hands and the chronograph hands is effected electrically by a motor, in which, in the reset state, setting is effected by a mechanical mechanism so that the chronograph hands may not move, in which the driving of the chronograph hands is effected after the releasing of the setting by the mechanical mechanism, and in which the operational feel of the operating portion at the time of chronograph measurement start operation is different from that at the time of chronograph measurement stop operation.

What is claimed is:

1. A chronograph timepiece comprising: an operating means for performing a starting operation, a stopping operation, and a resetting operation of a chronograph measurement; a chronograph measurement means performing a chronograph measurement operation within a predetermined maximum measurement time; a chronograph hand for indicating chronograph-measured time; a driving means for driving the chronograph hand; a control means which controls the chronograph measurement means so as to start the chronograph measurement operation within the maximum measurement time in response to the starting operation, stop the chronograph measurement operation in response to the stopping operation, and perform resetting of the chronograph measurement operation in response to the resetting operation, and which controls the driving means so as to drive the chronograph hand in accordance with the time measured by the chronograph measurement means; and a lever means which is displaced from a zero-restored state to a starting state in response to the starting operation to release setting so as to enable the chronograph hand to be moved, which is displaced from the starting state to the zero-restored state in response to the resetting operation to set and retain the chronograph hand, and which makes the operational feel of the operating means different between the starting state and the zero-restored state, wherein when the chronograph measurement means has measured the maximum measurement time to attain a measurement stop state, the control means controls the chronograph measurement means and the driving means so as to start chronograph measurement operation to drive the chronograph hand when the starting operation is performed after the resetting operation.

2. A chronograph timepiece according to claim 1, wherein when the maximum measurement time is measured, the control means controls the driving means such that the chronograph hand stops at a zero-restoring position.

3. A chronograph timepiece according to claim 1, wherein when the maximum measurement time is measured, the control means controls the driving means such that the chronograph hand stops at a position before a zero-restoring position by a predetermined amount.

4. A chronograph timepiece according to claim 3, wherein when the maximum measurement time is measured, the control means controls the driving means such that the chronograph hand stops at a position before the maximum measurement time by one step.

* * * * *